US009249979B2

(12) United States Patent
Zajadatz et al.

(10) Patent No.: US 9,249,979 B2
(45) Date of Patent: Feb. 2, 2016

(54) CONTROLLING A COMBUSTION DEVICE TO LOWER COMBUSTION-INDUCED PULSATIONS BY CHANGING AND RESETTING FUEL STAGINGS AT DIFFERENT RATES OF CHANGE

(75) Inventors: Martin Zajadatz, Küssaberg (DE); Solaf Sulta, Ludwigshafen (DE); Berthold Stay, Baden (CH)

(73) Assignee: ALSTOM TECHNOLOGY LTD., Baden (CH)

( * ) Notice: Subject to any disclaimer, the term of this patent is extended or adjusted under 35 U.S.C. 154(b) by 0 days.

(21) Appl. No.: 13/523,451

(22) Filed: Jun. 14, 2012

(65) Prior Publication Data

US 2012/0317986 A1 Dec. 20, 2012

(30) Foreign Application Priority Data

Jun. 20, 2011 (CH) ..... 01039/11

(51) Int. Cl.
*F23R 3/34* (2006.01)

(52) U.S. Cl.
CPC ..... *F23R 3/346* (2013.01); *F05B 2260/96* (2013.01); *F23D 2210/00* (2013.01); *F23R 2900/00013* (2013.01)

(58) Field of Classification Search
CPC ..... F23R 3/346
USPC ..... 60/725
See application file for complete search history.

(56) References Cited

U.S. PATENT DOCUMENTS

| | | | | |
|---|---|---|---|---|
| 6,769,903 | B2 | 8/2004 | Eroglu et al. | |
| 6,973,791 | B2 * | 12/2005 | Handelsman et al. | 60/773 |
| 7,003,939 | B1 * | 2/2006 | Rackwitz et al. | 60/786 |
| 2002/0142257 | A1 | 10/2002 | Eroglu et al. | |

(Continued)

FOREIGN PATENT DOCUMENTS

| | | | |
|---|---|---|---|
| EP | 0797051 | A2 | 9/1997 |
| EP | 1292795 | B1 | 3/2003 |

(Continued)

OTHER PUBLICATIONS

Japanese Office Action dated Sep. 8, 2014 for JP Patent Application Serial No. 2012-138660 (Japanese).

(Continued)

*Primary Examiner* — Gerald L Sung
*Assistant Examiner* — Scott Walthour
(74) *Attorney, Agent, or Firm* — Buchanan Ingersoll & Rooney PC

(57) ABSTRACT

A method is provided for operating a combustion device having at least one premix burner equipped with fuel stagings and is connected to a combustion chamber. The method includes changing, during transient operating states, the fuel staging of the at least one premix burner in accordance with combustion-induced pulsations which occur in the combustion chamber. A pulsation level of the pulsations which occur in the combustion chamber is continuously determined, the fuel staging of the at least one premix burner is changed for lowering the pulsation level if the pulsation level exceeds a predetermined maximum value, and, after a predetermined time interval, by the fuel staging being reset to the undisturbed value which determines the respective operating point if within the predetermined time interval the predetermined maximum value is not exceeded.

4 Claims, 3 Drawing Sheets

(56) References Cited

U.S. PATENT DOCUMENTS

| | | | | |
|---|---|---|---|---|
| 2004/0053181 | A1 | 3/2004 | Pennell et al. | |
| 2004/0194468 | A1* | 10/2004 | Ryan et al. | 60/773 |
| 2005/0034457 | A1* | 2/2005 | Gadde et al. | 60/737 |
| 2006/0000260 | A1* | 1/2006 | Benson et al. | 73/35.08 |
| 2006/0040225 | A1* | 2/2006 | Garay et al. | 431/114 |
| 2006/0266045 | A1 | 11/2006 | Bollhalder et al. | |
| 2007/0157624 | A1* | 7/2007 | Bland et al. | 60/776 |
| 2009/0125207 | A1* | 5/2009 | Nomura et al. | 701/100 |
| 2009/0133379 | A1 | 5/2009 | Mendoza et al. | |
| 2009/0217672 | A1* | 9/2009 | Bulat et al. | 60/772 |
| 2009/0229238 | A1* | 9/2009 | Zhang et al. | 60/39.24 |
| 2010/0050641 | A1* | 3/2010 | Nag | 60/736 |
| 2010/0154424 | A1* | 6/2010 | Twardochleb et al. | 60/740 |
| 2010/0286890 | A1* | 11/2010 | Chandler | 701/100 |

FOREIGN PATENT DOCUMENTS

| | | | |
|---|---|---|---|
| EP | 1331448 | A2 | 7/2003 |
| EP | 1533569 | A1 | 5/2005 |
| EP | 1688671 | A1 | 8/2006 |
| EP | 1205653 | B1 | 9/2006 |
| EP | 1344002 | B1 | 9/2009 |
| JP | H09170709 | A | 6/1997 |
| JP | 2004316506 | A | 11/2004 |
| JP | 3772633 | | 2/2006 |
| JP | 2009024669 | A | 2/2009 |
| WO | 2007082608 | A1 | 7/2007 |

OTHER PUBLICATIONS

Japanese Office Action dated Sep. 8, 2014 for JP Patent Application Serial No. 2012-138660 (English).

* cited by examiner

CONTROLLING A COMBUSTION DEVICE TO LOWER COMBUSTION-INDUCED PULSATIONS BY CHANGING AND RESETTING FUEL STAGINGS AT DIFFERENT RATES OF CHANGE

CROSS REFERENCE TO RELATED APPLICATION

The present application hereby claims priority under 35 U.S.C. Section 119 to Swiss Patent application number 01039/11, filed Jun. 20, 2011, the entire contents of which are hereby incorporated by reference.

FIELD OF INVENTION

The present invention relates to the field of combustion technology, particularly in relation to gas turbines. It refers to a method for operating a combustion device. It also refers to a combustion device for implementing the method.

BACKGROUND

Burner systems, which are operated in accordance with the concept of lean premix combustion, have low pollutant emissions but also a distinctly limited stability range. In addition to flashback into the mixing zone and to lift-off or quenching of the premix flame, thermoacoustic vibrations lead to distinct limitations in the operating behavior.

The operating behavior of premix burners can be improved by means of a staged fuel supply (see, for example, printed publications EP0797051 A2 or EP1205653 B1 or EP1292795 B1 or EP1344002 B1 or W02007/082608, which are incorporated by reference).

The fuel staging via a central device installed in the burner is shown in FIG. 1 by way of example for a double-cone burner or EV burner according to printed publication EP1292795 B1. FIG. 1 shows a premix burner 10, which has a double cone 12, into which leads a central fuel supply 11. The centrally injected fuel constitutes a first fuel stage 13. A second fuel stage 14 is created by additional fuel being injected into the air feed slots of the double cone 12.

By adjustment of the fuel proportion via the central fuel injection 11, 13 (fuel stage no.1) in relation to the fuel injection in the burner air slot 12, 14 (fuel stage no.2), the operating range of the burner 10 can be broadened with regard to quenching or lift-off of the premix flame and also with regard to flashback. The fuel staging also offers the possibility of optimizing the operating range of the burner 10 with regard to thermoacoustic vibrations and pollutant emissions.

Shown in FIG. 2 is a further premix burner 20 according to printed publication EP 0797051 A2 with a further design of the fuel staging. In the depicted design, the burner 20 has a double cone 16 to which is connected a mixer tube 17 towards the combustion chamber 15. An external fuel feed 18 is arranged at the end of the mixer tube 17. The fuel which is supplied there forms a fuel stage 19 (fuel stage no.1). The fuel which is supplied via the burner air slots of the double cone 16 forms a fuel stage 21 (fuel stage no.2). This depicted burner system can also be optimized by fuel staging with regard to thermoacoustic vibrations and pollutant emissions. In contrast to the burner system shown in FIG. 1 with central injection, premix burners with external fuel injection have an appreciably broadened operating range with regard to quenching or lift-off of the premix flame.

The parameters for the fuel staging—if the burners are part of a gas turbine—are determined by tuning runs during commissioning of the gas turbine. The parameters of the fuel staging can be predetermined in this case as a function of the output of the gas turbine, the ambient conditions, such as ambient temperature and air humidity, and the fuel composition. The parameters must also be predetermined with an adequate reserve so that even with transient operating states, such as loading or unloading of the gas turbine or changes to the gas composition, a reliable operation is ensured. Since these transient operating states in gas turbines very seldom occur, the premix burner cannot be operated to the greatest possible extent with minimum pollutant emissions.

A method for operating a premix burner with staged fuel injection is now known from printed publication EP1205653 B1, which has at least one first stage and at least one second stage, arranged downstream of the first stage, for introducing fuel into a combustion air flow, wherein pulsations of a combustion initiated by the burner and/or emission values of the combustion are detected, and the fuel feed to the first stage and second stage is controlled as a function of the detected pulsations and/or emission values. During steady-state operation, the fuel feed in this case is controlled in such a way that the operating point lies (permanently) below the maximum of the pulsations. During transient operation, on the other hand, the fuel feed is controlled in such a way that the operating point can lie (permanently) above the maximum of the pulsations. As a result, the reliability of the gas turbine may be limited during transient operation.

A method for controlling the ratio of the fuel flows in a first fuel supply line and in a second fuel supply line to a combustion device is known from printed publication W02007/082608, in which it is first of all determined whether the value of a first parameter—which shifts the operating point of the device towards a first undesirable operating range—has exceeded a predetermined limit value. If this limit value has been exceeded, the ratio of the fuel flows is changed so that the value of the first parameter falls short of the limit value. If this limit value has not been exceeded, it is determined whether the value of a second parameter—which shifts the operating point of the device towards a second undesirable operating range—has exceeded a predetermined limit value. If this limit value has been exceeded, the ratio of the fuel flows is changed so that the value of the second parameter falls short of the limit value. If this limit value has not been exceeded, the aforesaid steps are repeated in order to hold the values of the first and second parameters below the respective limit value. This type of controlling is comparatively costly and complicated.

SUMMARY

The present description is directed to a method for operating a combustion device, having at least one premix burner equipped with fuel stagings. The at least one premix burner is connected to a combustion chamber. The method includes changing, during transient operating states, the fuel stagings of the at least one premix burner in accordance with combustion-induced pulsations which occur in the combustion chamber. The method also includes continuously determining a pulsation level of the pulsations which occur in the combustion chamber and changing the fuel stagings of the at least one premix burner, lowering the pulsation level if the pulsation level exceeds a predetermined maximum value. The method also includes resetting, after a predetermined time interval, the fuel stagings to an undisturbed value which determines the respective operating point if within said time interval the predetermined maximum value is not exceeded.

The disclosure is also directed to a combustion device including a combustion chamber and at least one premix burner connected to the combustion chamber and equipped with fuel stagings. The fuel staging can be changed by a control unit in accordance with combustion-induced pulsations which are picked up by measuring devices arranged in the combustion chamber, the control unit is connected to a timer by which a time interval for controlling the stagings is predefined.

BRIEF DESCRIPTION OF THE DRAWINGS

The invention shall subsequently be explained in more detail based on exemplary embodiments in conjunction with the drawing. In the drawings.

DETAILED DESCRIPTION OF THE PREFERRED EMBODIMENTS

Introduction to the Embodiments

Figure 1:
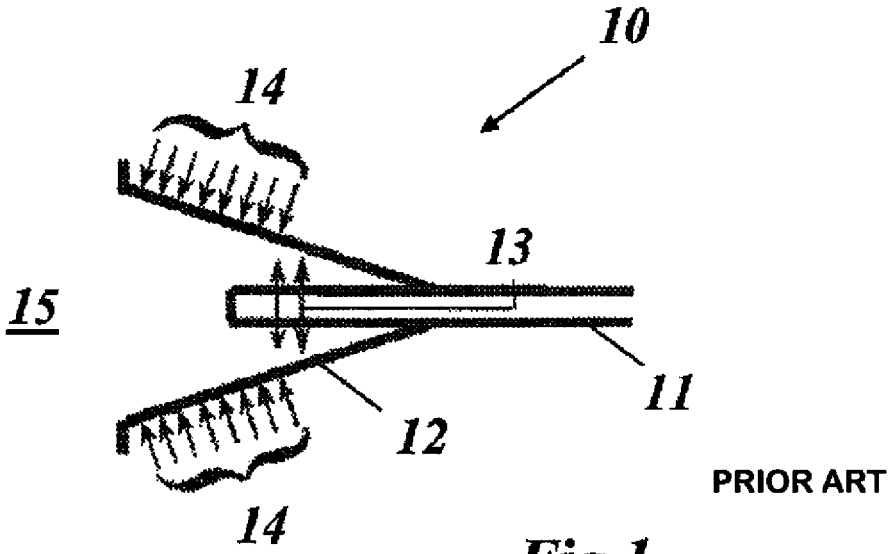
FIG. 1 shows, in a greatly simplified view, a double-cone burner or EV burner which as a premix burner with two internal fuel stages is suitable for implementing the method according to the invention.
Figure 2:
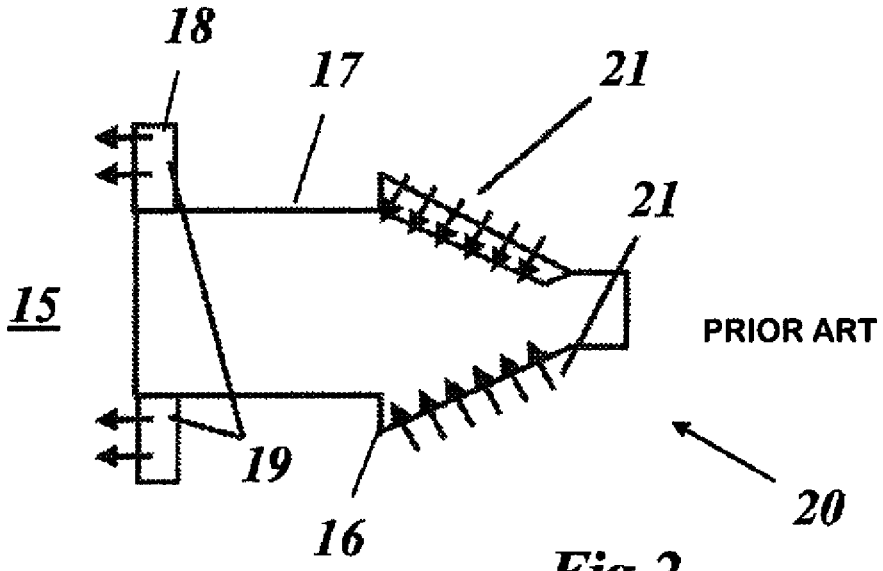
FIG. 2 shows, in a greatly simplified view, a further premix burner with two fuel stages, one of which is arranged at the outlet of a mixer tube.

It is therefore an object of the invention to disclose a method for controlling a premix burner equipped with fuel stagings, which with unchanged effectiveness is made appreciably simpler with regard to the avoidance of pulsations.

It is also an object of the invention to disclose a combustion device for implementing the method. The object is achieved by the appended independent claims.

The method according to the invention is based on a combustion device which has at least one premix burner which is equipped with fuel staging and is connected to a combustion chamber, wherein during transient operating states the fuel staging of the at least one premix burner is changed in accordance with the combustion-induced pulsations which occur in the combustion chamber. According to the method, a pulsation level of the pulsations which occur in the combustion chamber is continuously determined, the fuel staging of the at least one premix burner is changed for lowering the pulsation level if the pulsation level exceeds a predetermined maximum value, and after a predetermined time interval the fuel staging is reset to the undisturbed value which determines the respective operating point if within this time interval the predetermined maximum value is not exceeded.

In one embodiment of the method according to the invention, the fuel staging, in the event of the maximum value of the pulsation level being exceeded, is changed by a predefined value. This change is carried out in a particularly rapid manner, as a result of which a particularly simple process execution is achieved.

According to another embodiment the fuel staging, in the event of the maximum value of the pulsation level being exceeded, is changed step-by-step by a plurality of predefined values until either the predetermined maximum value of the pulsation level is fallen short of or an extreme value for the fuel staging is achieved. As a result of this, the fuel staging can be adjusted to the conditions in a more flexible and finer manner.

In a further embodiment of the method according to the invention, the fuel staging, with a constant rate of change, is reset to the undisturbed value which defines the respective operating point. During transient states, this undisturbed value usually deviates from the initial value of the fuel staging since the device has moved towards another operating point within the lapsed time interval.

In yet another embodiment, the fuel staging of the at least one premix burner is changed at least one additional time for lowering the pulsation level if the pulsation level exceeds the predetermined maximum value again within the predetermined time interval. This may be particularly necessary when the operating point is changed particularly quickly during transient operation.

In particular, in the method according to the invention, the overall fuel flow is kept constant while the fuel staging is being changed.

The combustion device according to the invention for implementing the method according to the invention has a combustion chamber and also at least one premix burner which is connected to the combustion chamber and equipped with fuel staging, wherein the fuel staging can be changed by a control unit in accordance with the combustion-induced pulsations which are picked up by measuring means arranged in the combustion chamber. The device is characterized in that the control unit is connected to a timer by means of which a time interval for the controlling is predefined. The timer can be an external timer or part of the control unit.

In one embodiment of the device according to the invention, the at least one premix burner is supplied with fuel via at least two distribution lines in the course of the fuel staging, the at least two distribution lines are connected to means of adjustment which can be operated by the control unit in such a way that a constant overall fuel flow can be apportioned to the at least two distribution lines in different ways.

The measuring means preferably comprise at least one sensor, which is arranged in the combustion chamber, for picking up pressure fluctuations.

Detailed Description

Using the method which is proposed here, by means of dynamic controlling, the operating range of a burner system with fuel staging is optimized. The controlling relates basically to transient operating states of a combustion device. The method can be used for controlling all burners which have internal fuel staging. The combustion device is preferably implemented in a gas turbine which customarily includes a measuring sensor, or a group of measuring sensors, in the combustion chamber for detecting flame-generated pulsations.

Figure 3:
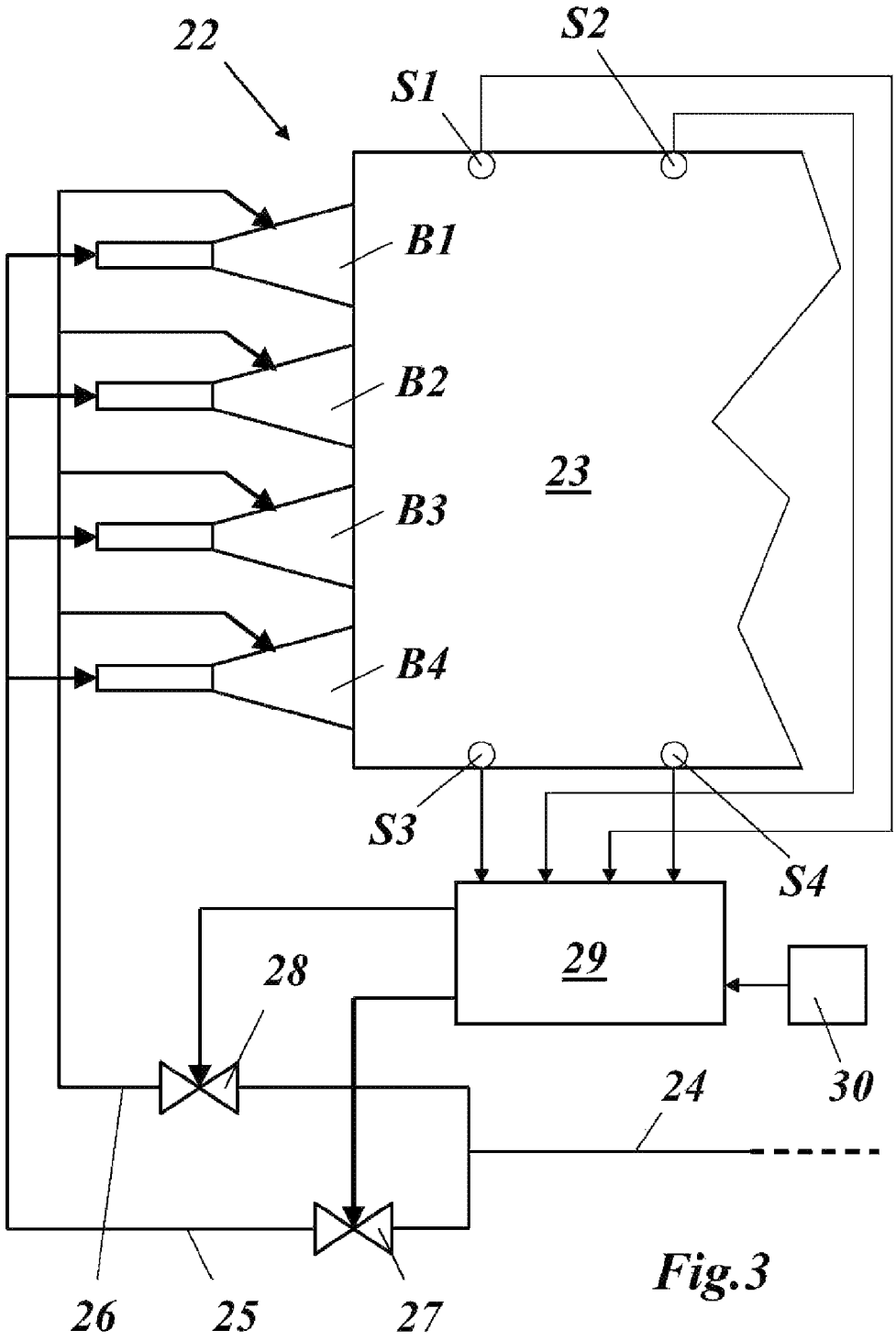
FIG. 3 shows the schematic arrangement of a combustion device according to an exemplary embodiment of the invention.

Reproduced in FIG. 3 is a schematic arrangement of a corresponding combustion device 22. The combustion device 22 comprises a combustion chamber 23 in which, as a result of the combustion of a fuel, hot gas is produced, the hot gas drives a corresponding turbine (not shown) in a gas turbine, for example. A plurality of premix burners B1, . . . ,B4 of a similar type, which are operated in parallel and are equipped in each case with fuel staging (with two stages in this case), are arranged on the combustion chamber 23. For this purpose, each of the premix burners B1, . . . ,B4 is supplied with fuel at two different points via two separate distribution lines 25 and 26, the fuel being introduced via a common fuel feed line 24. The overall fuel flow coming in via the fuel feed line 24 is apportioned in the depicted example to the two distribution lines 25 and 26 by means of two control valves 27 and 28 in the desired manner. It should be understood that other valve arrangements are also conceivable in order to enable the apportioning of the fuel.

The control valves 27 and 28 are operated by a control unit 29 which receives input signals from a plurality of sensors S1, . . . ,S4 which are arranged in (or on) the combustion chamber 23 and pick up combustion-induced (pressure) pulsations which occur in the combustion chamber 23. Also associated with the control unit 29 is a timer 30 which gives the control unit 29 a fixed (possibly also adjustable) time interval At after which the control unit 29 automatically undertakes a change of the fuel staging via the control valves 27 and 28. In the example of FIG. 3, the fuel staging of all the premix burners B1, . . . ,B4 is changed at the same time and all together. It is also conceivable, however, that only a selected number of the premix burners B1, . . . ,B4 are equipped with fuel staging or are changed. By the same token, it is conceivable that premix burners with 3-stage or multistage fuel staging are used.

It is the aim of the controlling to adjust the fuel staging(s) inside the burners for a limited time period Δt so that a reliable operation of the combustion device or of the gas turbine is made possible during transient operation. After this time period Δt, the controller is deactivated and the combustion device or gas turbine can be operated again with optimum fuel staging.

Figure 4:
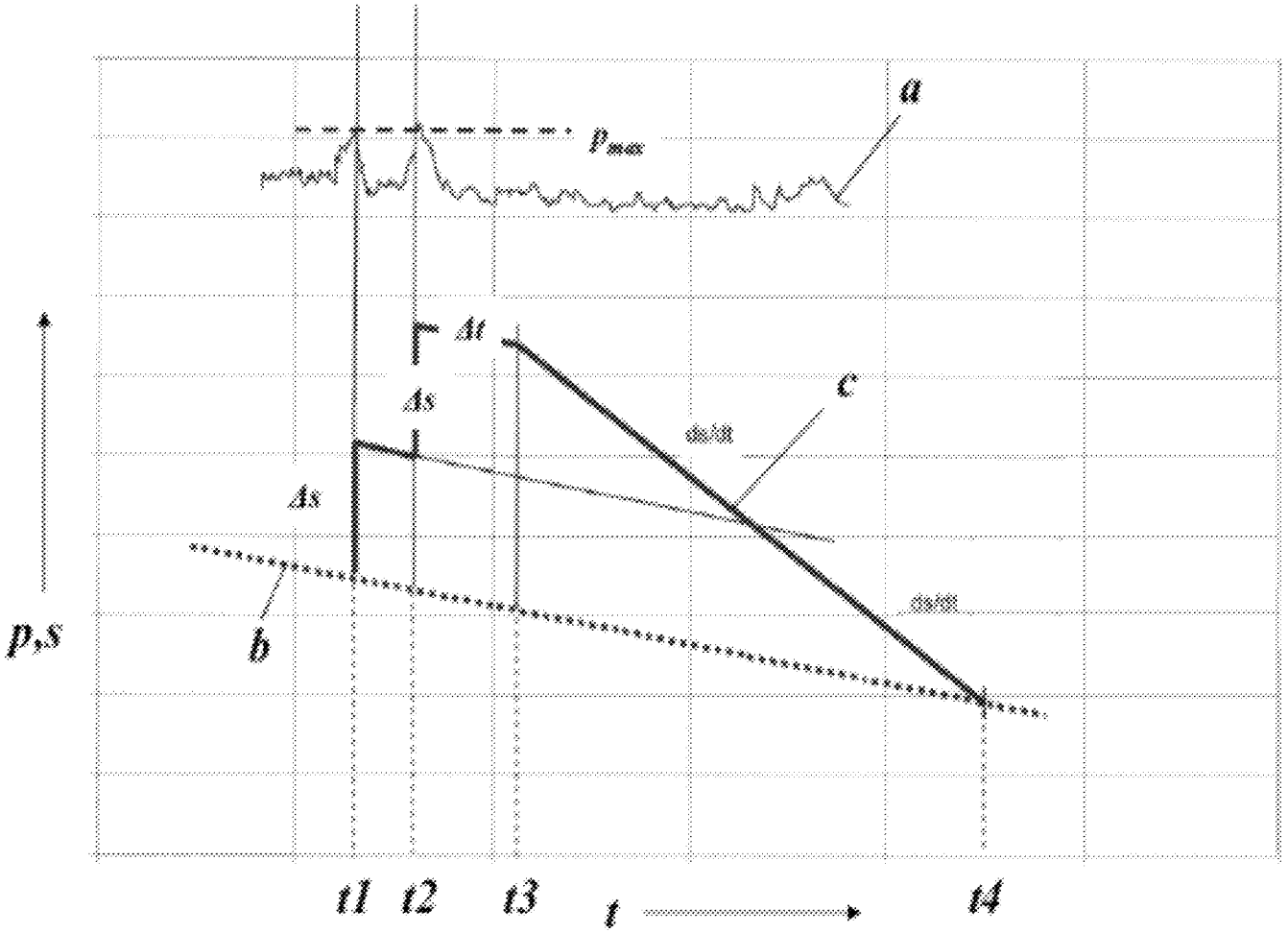
FIG. 4 shows a diagram of an exemplary time interval of the combustion-induced pulsations p (curve a) in a combustion device according to FIG. 3 and the fuel staging s (curve b or c), which is subsequently changed by a control process, according to an exemplary embodiment of the method according to the invention.

A schematic representation of the parameters which are relevant to the controlling is shown in FIG. 4 for a load change of the gas turbine. The fuel staging during steady-state operation is reproduced in this case by means of the dotted curve b. The activation of the controller or the change of the fuel staging s is initiated at time point t1 as a result of a limit value pmax (drawn in a dashed line) of the pulsation level p of the flame-generated pulsations (curve a) being exceeded, which occurs during the load change. With activation of the controller, the ratio of the fuel flows to the individual fuel stages s with constant overall fuel flow is changed so that the process can be carried out with adequate operating reliability (curve c—in continuous line) as a result of the rapid change to the fuel staging by the predetermined change value (staging difference) Δs.

The process can also be repeated a number of times depending upon the extent of the pulsation level. After a predetermined time period Δt with a sufficiently low pulsation level (e.g. at time point t3), the fuel ratio is reset to the value for the fuel stagings with a gradient ds/dt (rate of change), which is optimum for the new operating point. After this (after time point t4), the control system is deactivated. If within the time period Δt the limit value pmax of the pulsation level p of the flame-generated pulsations is exceeded again (time point t2 in FIG. 4), the fuel staging s is again changed by Δs. The time period or the time interval Δt then begins to run again.

Depending upon the boundary condition or manner of the transient process, different fuel stagings can be created for the operational reliability of the gas turbine. In such a case, the adjustment of the fuel staging can be repeated at a plurality of intervals Δt until the flame-generated pulsations fall below the limit value or a maximum value for the fuel staging smax is achieved. If the pulsations increase further even at the maximum value of the fuel staging, the gas turbine can be shut down as a result of a protective load shedding, for example.

Overall, by using the invention, particularly a controlling of a gas turbine with at least one premix burner with two or more fuel stagings, which is optimized in steady-state operation for the reduction of pollutant emissions, is made possible by at least one of the fuel stagings being adjusted as a function of combustion-induced pulsations during transient operating states.

The controlling can apply in this case to gaseous and/or liquid fuels.

The controlling is especially applicable to transient processes, such as frequency back-up control, change of the gas composition or of the gas initial pressure and also load changes with low pollutant emissions.

The adjustment of the fuel staging can be carried out in this case in a plurality of equal or different steps.

It is also conceivable, however, to use the controlling for adjustment of the steady-state operating curve of the fuel staging if continuous operation at the optimized fuel staging is not possible on account of increased combustion-induced pulsations.

LIST OF DESIGNATIONS

10, 20 Premix burner
11 Central fuel feed
12, 16 Double cone
13, 14 Fuel stage
15, 23 Combustion chamber
17 Mixer tube
18 External fuel feed
19, 21 Fuel stage
22 Combustion device
24 Fuel feed line
25, 26 Distribution line
27, 28 Control valve
29 Control unit
30 Timer
B1, . . . ,B4 Premix burner
Pulsation level
S1, . . . ,S4 Sensor
s Fuel staging
Δs Staging difference (change value)
Δt Time interval
ds/dt Rate of change of the fuel staging
t1, . . . ,t4 Time point

What is claimed is:

1. A combustion device comprising a combustion chamber and at least one premix burner connected to the combustion chamber and equipped with fuel stagings, wherein the fuel stagings are changeable by a control unit with an associated timer, the control unit being communicatively connected to at least one sensor that is configured to detect a pulsation level of combustion induced pulsations, wherein the control unit is configured to lower the pulsation level when the pulsation level exceeds a predetermined maximum value within a first predetermined time interval by:

(i) changing the fuel stagings of the at least one premix burner with a first rate of change to lower the pulsation level when the pulsation level exceeds the predetermined maximum value within the first predetermined time interval to initiate adjustment of an operational point of the combustion device from a first operational point to a second operational point, and (ii) resetting the fuel stagings with a second non-zero rate of change to a value that determines the second operational point of the combustion device when the predetermined maximum value is not exceeded within a second predetermined time interval that is greater than zero seconds and is subsequent to the first predetermined time interval, the second non-zero rate of change being smaller than the first rate of change.

2. The combustion device of claim 1, wherein the control unit is further configured so that an overall fuel flow is kept constant while the fuel stagings of the at least one premix burner are being changed with the first rate of change to lower the pulsation level of combustion.

3. The combustion device of claim 1, wherein the combustion device is a gas turbine.

4. The combustion device of claim 1, wherein the at least one premix burner is comprised of a plurality of burners that are each fed fuel from at least two distribution lines.

* * * * *